US006209588B1

(12) United States Patent
Reinhardt et al.

(10) Patent No.: US 6,209,588 B1
(45) Date of Patent: Apr. 3, 2001

(54) WEAVING MACHINE WITH PNEUMATIC WEFT INSERTION AND CATCH SELVEDGE FORMING DEVICE

(75) Inventors: Herbert Reinhardt, Achberg; Peter Czura, Wangen, both of (DE)

(73) Assignee: Lindauer Dornier Gesellschaft GmbH, Lindau (DE)

( * ) Notice: Subject to any disclaimer, the term of this patent is extended or adjusted under 35 U.S.C. 154(b) by 0 days.

(21) Appl. No.: 09/233,031

(22) Filed: Jan. 20, 1999

(30) Foreign Application Priority Data

Jan. 27, 1998 (DE) ..... 198 02 910

(51) Int. Cl.[7] ..... D03D 51/34; D03D 47/48

(52) U.S. Cl. ..... 139/194; 139/302; 139/370.2

(58) Field of Search ..... 139/302, 195, 139/434, 194, 370.2

(56) References Cited

U.S. PATENT DOCUMENTS

| | | | | |
|---|---|---|---|---|
| 4,432,399 | | 2/1984 | Bachmann et al. | 139/370.2 |
| 4,465,110 | * | 8/1984 | Dekker | 139/370.2 |
| 5,083,584 | * | 1/1992 | Weidmann et al. | 139/370.2 |
| 5,253,681 | | 10/1993 | Cramer et al. | 139/192 |
| 5,649,570 | | 7/1997 | Wahhoud et al. | 139/291 C |
| 5,735,316 | | 4/1998 | Hehle | 139/194 |
| 5,782,271 | * | 7/1998 | Whahhoud et al. | 139/192 |

FOREIGN PATENT DOCUMENTS

| | | |
|---|---|---|
| 4118411C1 | 8/1992 | (DE) . |
| 19545839C1 | 8/1996 | (DE) . |
| 19548846C1 | 10/1996 | (DE) . |

OTHER PUBLICATIONS

Offiice Action, Germany, Aug. 10, 1998 Untranslated.

* cited by examiner

*Primary Examiner*—Andy Falik
(74) *Attorney, Agent, or Firm*—Evenson, McKeown, Edwards & Lenahan, P.L.L.C.

(57) ABSTRACT

A weaving machine with pneumatic weft insertion is provided which includes a fixed reed filler at an output end of a reed when it is in a weft insertion position. A catch salvage forming device is disposed at an output end of the fixed reed filler when the reed is in the weft insertion position and serves to keep the inserted weft stretched during movements of the reed between a weft insertion and a beating up position. In order to shorten the overall length of the assembly, a weft stop motion for detecting the insertion of the weft is located on the fixed reed filler.

9 Claims, 2 Drawing Sheets

WEAVING MACHINE WITH PNEUMATIC WEFT INSERTION AND CATCH SELVEDGE FORMING DEVICE

BACKGROUND AND SUMMARY OF THE INVENTION

This application claims the priority of German application 198 02 910.1-26, filed in Germany on Jan. 27, 1998.

The invention relates to a weaving machine with a reed having a weft insertion channel, the reed being connected with a reed stay. The reed pivots alternately from a weft insertion position into a weft beating-up position. At least one reed filler is located on the output side of the weft insertion channel in a stationary position in the weft insertion position, the filler having a weft channel. At least one device is provided in the weft beating-up position on the output side of the reed for cutting a weft beaten up on the beating-up edge of a fabric. At least one device is provided for forming a tucked selvedge on the fabric. At least one weft stop motion is located on the output side of the weft insertion channel for detecting the correct insertion of the weft.

A weaving machine with at least one reed filler located on the output side of the insertion channel of a reed in a stationary position in the weft insertion position is known from European Patent 0 532 931 (corresponds also to U.S. Pat. No. 5,253,181).

To monitor the correct insertion of a weft, in known fashion, a first weft stop motion is provided on the output side of the weft insertion channel that is either integrated in the end area of the reciprocating reed or which is located on the output side of the weft insertion channel at a distance from the reed in an auxiliary reed that is connected with the reed stop.

An auxiliary reed of this kind is known from French Patent 2,494,731 (corresponds also to U.S. Pat. No. 4,432,399), which has, in addition to the first weft stop motion in the plane of the weft insertion, a second weft stop motion at a distance therefrom. A reed of this kind with a weft stop motion in the input and output areas of the thread channel is connected with the reed stay at a distance from the reed.

The use of an auxiliary reed of this kind is not suitable in conjunction with a device for forming a tucked selvedge, particularly because no means are provided for keeping the inserted weft stretched downstream from the first weft stop motion.

A weaving machine for producing single- or multi-web fabric is known from German Patent 44 43 899 (corresponds also to U.S. Pat. No. 5,649,570), which has at least a combination of a cutting device and a tucker mean.

In the weft insertion position, at least on the output side of the weft insertion channel of the reed, a reed filler is located in a fixed position. An auxiliary reed for forming a so-called catch selvedge is located downstream from the stationary reed filler. The auxiliary reed performs the same oscillating movements as the reed for inserting the weft and beating it up. At least one weft stop motion is integrated into the auxiliary reed that has a weft channel on the output side of the weft, said stop motion detecting the correct insertion of the weft for the weaving machine control.

In view of the fact that the at least one weft stop motion is located in said auxiliary reed on the output side of the weft, the free end of the inserted weft must have a length which is at least great enough for the end to pass the first weft stop motion.

This arrangement of said first weft stop motion produces a weft waste of several millimeters.

A goal of the invention therefore is to provide measures to prevent the abovementioned weft waste from occurring.

According to the invention, this goal is achieved in that at least the first weft stop motion is integrated on the output side of the weft insertion channel with the reed filler which is in a fixed position.

The solution according to the invention results in a reduction of the weft waste which corresponds at least to the length of the first weft stop motion integrated into the reed filler.

Other objects, advantages and novel features of the present invention will become apparent from the following detailed description of the invention when considered in conjunction with the accompanying drawings.

DETAILED DESCRIPTION OF THE DRAWINGS

Figure 1:
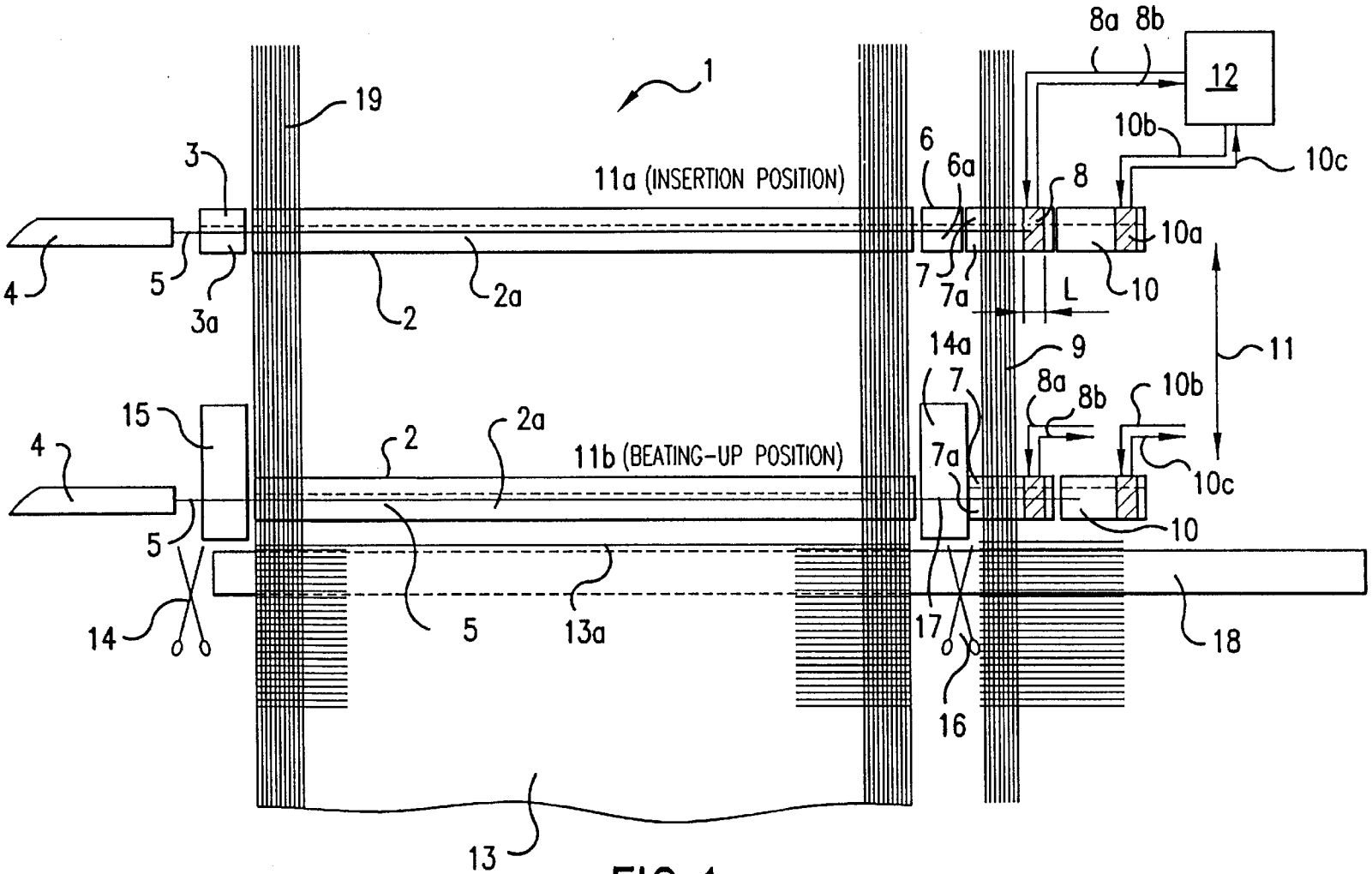
FIG. 1 PRIOR ART
FIG. 1 is a schematic top view of a weaving machine according to the prior art.

FIG. 1 shows a schematic top view of a weaving machine with a main warp 19, a reed 2 and a first reed filler 3 with weft channel 3*a*. A weft insertion device operates pneumatically and is located upstream from the first reed filler 3. A fabric support 18 is located in front of the beating-up edge 13*a* of a fabric being woven. Downstream from reed 2 on the output side of the weft insertion channel 2*a* is a second reed filler 6 with reed channel 6*a*, as well as an auxiliary reed 7 with a weft channel 7*a* and a weft-stretching and detecting device 10.

When weft 5 enters weft insertion channel 2*a* of reed 2, weft 5 crosses the first reed filler 3 located in a stationary position in reed insertion position 11*a*, then the weft insertion channel 2*a* of reed 2 that is in insertion position 11*a*, and thus crosses on the output side of weft insertion channel 2*a* the thread channel 6*a* of second reed filler 6.

Downstream from second reed filler 6 is auxiliary reed 7 with a first thread stop motion 8, with auxiliary reed 7 serving to produce a so-called catch selvedge. Weft 5 then passes through thread channel 7*a* of an auxiliary reed 7and is stretched by the weft-stretching and detecting device. Auxiliary reed 7 and the weft-stretching and detecting device 10 with a weft stop motion 10*a*, like reed 2, is permanently connected with the reed (not shown) that performs the oscillating movements of reed 2 in the direction of double arrow 11. The first weft stop motion 8 integrated into auxiliary reed 7 signals the arrival of an inserted weft through lines 8b to weaving machine control 12.

The first weft stop motion 8 can be located on the output or input side of the auxiliary reed 7.

It will be clear to the individual skilled in the art from the above that in addition to the necessary weft length for producing the so-called catch selvedge 9, an additional length (L) is required to ensure detection of the arrival and/or detection of the correct weft insertion by the first weft stop motion 8 and corresponding signal via lines 8*a*, 8*b*.

According to the state of the art presented with respect to FIG. 1, on the output side of auxiliary reed 7*a* weft-stretching and detecting device 10 is provided that comprises a second weft stop motion 10*a*. The weft stop motion 10*a*, when so-called "long shots" or "weft breakers" occur, interrupts the weaving process in conjunction with weaving machine control 12.

Figure 2:
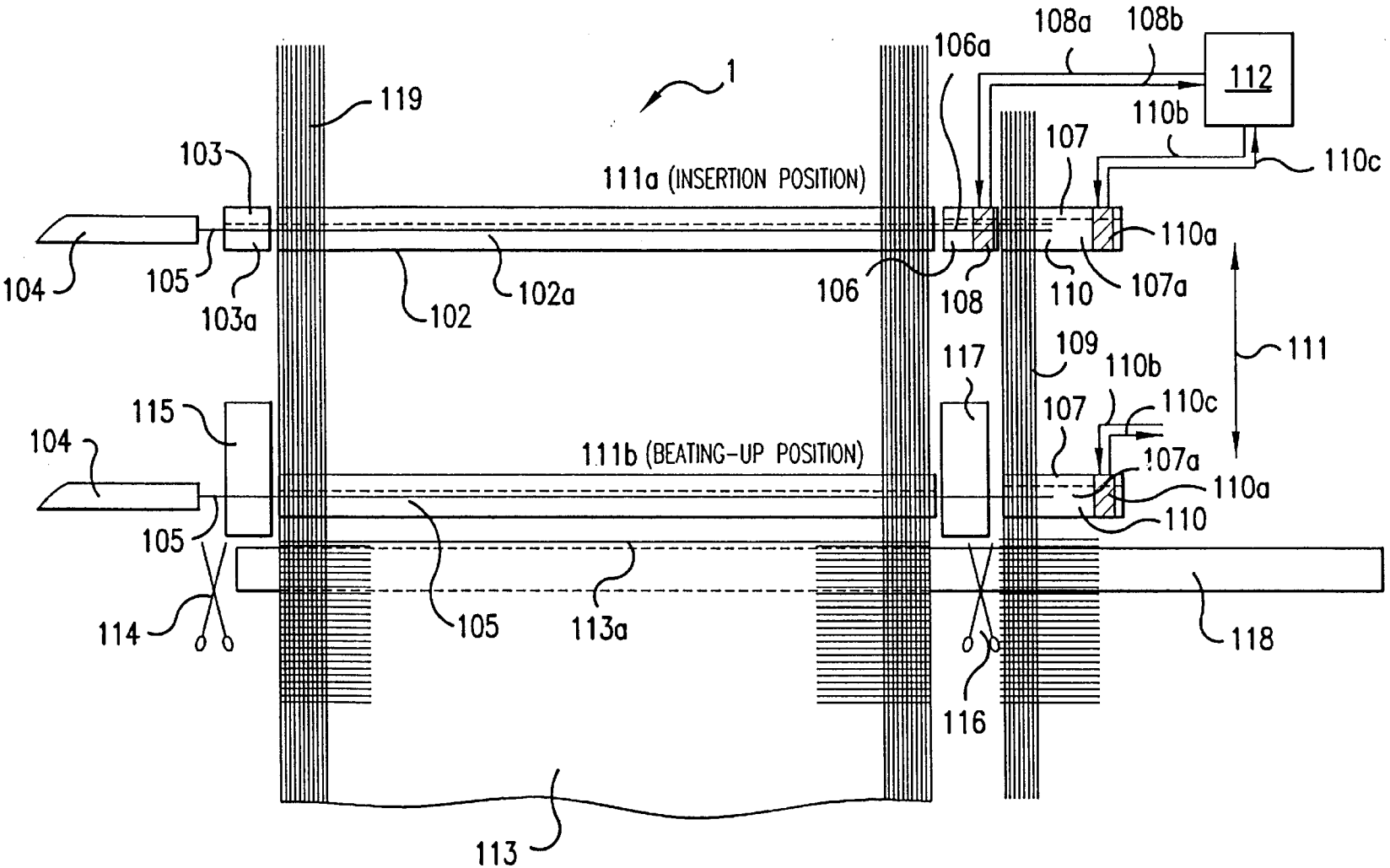
FIG. 2 is a schematic top view of a weaving machine, with the arrangement of a first weft stop motion according to the invention.

FIG. 2 depicts a preferred embodiment of the invention. In FIG. 2, similar reference numbers as in the FIG. 1 embodiment, increased by 100, are used to depict similar features. Unless otherwise indicated below, the description of the corresponding feature for FIG. 1 applies.

In FIG. 2, according to the invention, the first weft stop motion 108 is integrated into the stationary reed filler 106, which is located in weft insertion position 111*a* immediately on the output side of weft insertion channel 102*a*. On the output side of weft channel 106*a* of reed filler 106 a technical unit is located that is composed of a combination of a known auxiliary reed 107 and a known weft-stretching and detecting device 110, which is connected in the same way as reed 102 permanently with the reed stay of weaving machine 101.

The location according to the invention of the first weft stop motion 108 in reed filler 106 thus results in a savings of weft length that corresponds to the length (L) of the weft stop motion 8 according to FIG. 1 integrated into reed filler 6.

The solution according to the invention also achieves the advantage that the signal leads 108*a* and 108*b* of weft stop motion 108 that lead to weaving machine control 112 are not subject to any dynamic stress and hence the risk of the signal lead cables breaking is largely eliminated.

The operation of the weaving machine following insertion of the weft in weft insertion position 111*a* shown is as follows:

Reed 102 moves together with weft insertion device 104 and the technical unit consisting of auxiliary reed 107 and weft-stretching and detecting device 110, in which weft 105 is held stretched, into the weft beating-up position 11*b* of reed 102. In other words weft 105 is beaten up here against beating-up edge 113*a* of fabric 113 and then cut by scissors 114, positioned on the one hand between weft insertion device 104 and tucking means 115 and cut by a scissors 116 positioned on the other hand between a tucking means 117 and technical unit 107, 110. The ends of beaten-up weft 105 are grasped by the tucking means 115, 117 known of itself, guided back into a following shed, and beaten up with an additional weft firmly against fabric edge 113*a*.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Weaving machine with pneumatic weft insertion, comprising:

a reed having a weft insertion channel and movable in use between a weft insertion position and a weft beating up position, a fixed reed filler located in a stationary position on an output end of the weft insertion channel when the reed is in the weft insertion position, a catch selvedge forming device disposed at an output end of the fixed reed filler when the reed is in the weft insertion position, said catch selvedge forming device being operable to keep the inserted weft stretched during movements of the reed between the weft insertion and beating up positions, and a weft stop motion located on the fixed reed filler and operable to detect insertion of the weft.

2. Weaving machine according to claim 1, wherein the catch selvedge forming device includes a second weft stop motion operable to detect weft portions disposed at an output side of the fixed reed filler.

3. Weaving machine according to claim 1, wherein the catch selvedge forming device includes an auxiliary reed disposed at an output end of the fixed reed filler, said auxiliary reed being movable together with the reed between the weft insertion position and the weft beating up position.

4. Weaving machine according to claim 2, wherein the catch selvedge forming device includes an auxiliary reed disposed at an output end of the fixed reed filler, said auxiliary reed being movable together with the reed between the weft insertion position and the weft beating up position.

5. Weaving machine according to claim 4, wherein the second weft stop motion is disposed on and movable with the auxiliary reed.

6. Weaving machine according to claim 4, comprising a weaving machine control operable to control operation of the weaving machine, and wherein the weft stop motion located on the fixed reed filler is connected with weaving machine control signal leads so they are not subjected to dynamic stresses during machine operation with movement of the reed between the weft insertion and beating up positions.

7. Weaving machine according to claim 5, wherein the catch selvedge forming device includes a cutting device operable to cut the catch selvedge when the reed is in the weft beating up position.

8. Weaving machine according to claim 5, comprising a weaving machine control operable to control operation of the weaving machine, and wherein the weft stop motion located on the fixed reed filler is connected with weaving machine control signal leads so they are not subjected to dynamic stresses during machine operation with movement of the reed between the weft insertion and beating up positions.

9. Weaving machine according to claim 1, comprising a weaving machine control operable to control operation of the weaving machine, and wherein the weft stop motion located on the fixed reed filler is connected with weaving machine control signal leads so they are not subjected to dynamic stresses during machine operation with movement of the reed between the weft insertion and beating up positions.

* * * * *